US006302636B1

(12) United States Patent
Duron

(10) Patent No.: US 6,302,636 B1
(45) Date of Patent: Oct. 16, 2001

(54) CONTAINER BODY FOR RECYCLABLE REFUSE COLLECTION VEHICLE

(75) Inventor: Alain Duron, Chelsea (CA)

(73) Assignee: Markland Inc., Aylmer (CA)

( * ) Notice: Subject to any disclaimer, the term of this patent is extended or adjusted under 35 U.S.C. 154(b) by 0 days.

(21) Appl. No.: 09/534,619

(22) Filed: Mar. 27, 2000

Related U.S. Application Data

(63) Continuation-in-part of application No. 09/071,349, filed on May 1, 1998, now Pat. No. 6,071,057.

(30) Foreign Application Priority Data

May 2, 1997 (CA) ..... 2204318
Jul. 22, 1997 (CA) ..... 2211288

(51) Int. Cl.[7] ..... B65F 3/02

(52) U.S. Cl. ..... 414/409; 414/487; 414/512; 414/517

(58) Field of Search ..... 414/406, 407, 414/409, 487, 492, 497, 511, 512, 517, 525.2, 525.6, 679; 220/531, 534, 541, 544, 545, 909

(56) References Cited

U.S. PATENT DOCUMENTS 992,006 * 5/1911 Kubersky et al. .
4,114,776 * 9/1978 Pluss .
4,557,658 * 12/1985 Lutz ..... 414/512 X
4,627,783 * 12/1986 De Filippi ..... 414/511 X
4,700,640 * 10/1987 Andersson .
4,840,531 6/1989 Dinneen .
5,035,564 * 7/1991 Matsumoto ..... 414/409
5,122,025 * 6/1992 Glomski ..... 414/517 X
5,344,273 * 9/1994 Radlein ..... 414/409
5,813,818 * 9/1998 McNeilus et al. ..... 414/407
5,823,728 * 10/1998 Veldman et al. ..... 414/517 X
6,071,057 * 6/2000 Duron et al. ..... 414/517

FOREIGN PATENT DOCUMENTS 1264702 of 1990 (CA) .
2027168 of 1991 (CA) .
1299530 of 1992 (CA) .
4024568 * 2/1992 (DE) ..... 414/512
285467 * 10/1988 (EP) ..... 414/525.6
365514 * 4/1990 (EP) ..... 414/521

* cited by examiner

*Primary Examiner*—James W. Keenan
(74) *Attorney, Agent, or Firm*—Robert G. Hendry

(57) ABSTRACT

A refuse collection container for mounting on a vehicle. The container is particularly suitable for separating and compacting recyclable materials due to the provision of a longitudinally extending diagonal partition. The container has a pair of refuse receiving buckets preferably adapted to be raised into alignment with apertures in the front wall of the container. Recyclable materials, sorted by type in the buckets, are then moved into the container by a compactor blade in each bucket. Discharge of the materials is facilitated by providing for swinging movement of the partition prior to the vehicle being in the dumping position. The partition is extensible so that when positioned diagonally with respect to side walls of the container, the partition extends to the discharge end of the container.

4 Claims, 5 Drawing Sheets

CONTAINER BODY FOR RECYCLABLE REFUSE COLLECTION VEHICLE

CROSS REFERENCE TO RELATED APPLICATION

This application is a continuation in part of U.S. Ser. No. 09/071,349 filed May 1, 1998 now U.S. Pat. No. 6,071,057.

This invention relates to refuse collecting vehicles and more particularly to a container body for collecting recyclable materials.

BACKGROUND OF THE INVENTION

Problems encountered in providing prior art device include the inefficiency of rear loading which required two operators while front loading can be carried out by a single operator. This concept is shown in U.S. Pat. No. 2,750,055 and includes provision for loading on both sides of the vehicle.

Separating the recyclables into at least two compartments is also a requirement. In this regard, horizontal dividers have been used as shown in Canadian Patent 2,027,168. However, loading and compacting operations are complicated because the materials are not loaded from the top. Similarly, transverse dividers as shown in Canadian Patent 1,299,530 have to be moved to permit unloading. Unless side dumping of the container is provided, such a feature requires complete redesign of the vehicle and the method of operation.

Lifting the material to obtain maximum filling of the container body as shown in Canadian Patent 1,264,702 is desirable and a conveyor for this purpose is shown in Canadian Patent 2,129,629. However, it is also desirable to compact the materials, and it has been found that hydraulic rams used to move materials up a sloping floor caused breakage of glass bottles with the result that powdered glass adversely effected the operation of the hydraulic rams. Although compacting is essential for economy reasons, the rams travel on long rails thus increasing the weight of the vehicle. Rams of this type, as shown in Canadian application 2,027,168 take up space required for recyclables.

This invention seeks to provide an apparatus for collecting recyclables positioned immediately behind the cab of the vehicle in front of a container body.

The invention also seeks to provide buckets on both sides of the vehicle at a convenient height for loading from either side by a single driver operator.

The invention further seeks to provide an adjustable, extendible, longitudinal extending vertical partition in the container body for separating paper from other recyclables.

Furthermore, the invention seeks to provide means for raising selected recyclables to the top of the container body and compacting the containers and paper recyclables during the loading cycle.

STATEMENT OF THE INVENTION

Accordingly, the present invention resides in the provision of a refuse collecting body for use on a vehicle, the body including first and second end walls, a top wall, and a bottom wall, the first end wall having a load receiving aperture, and the second end wall being a discharge end of the container. An upwardly moveable loading bucket having a pair of upright side walls and a bottom wall defining first and second open ends, a first end of the bucket being blocked by the first end wall of the container in a loading position and a fixed wall for blocking the second end of the bucket during loading and upward movement, hydraulic cylinder means to raise the bucket to and upper unloading position. A compressor blade mounted above the fixed wall slidably mounted to be moved into the bucket by reciprocal actuating means when the bucket is raised to a compacting and, or unloading position in line with the load receiving aperture of the first end wall of the container body.

Accordingly, the present invention further resides in a refuse collecting container for use on a refuse collection vehicle, said container comprising:

first and second end walls, side walls, a top wall and a bottom wall, said first end wall having a load receiving aperture, and the second end wall being a discharge end of the container;

at least two loading buckets each having a pair of upright side walls, and a bottom wall defining first and second ends of the bucket; and a compressor blade having actuator means for moving the blade through the bucket and an aligned aperture in the first end wall of the container; and including a vertical longitudinal partition extending from the first end wall to the discharge end of the container and dividing the container into two compartments.

BRIEF DESCRIPTION OF THE DRAWINGS

In the drawings which illustrate a preferred embodiment of the invention.

DETAILED DESCRIPTION

Figure 1:
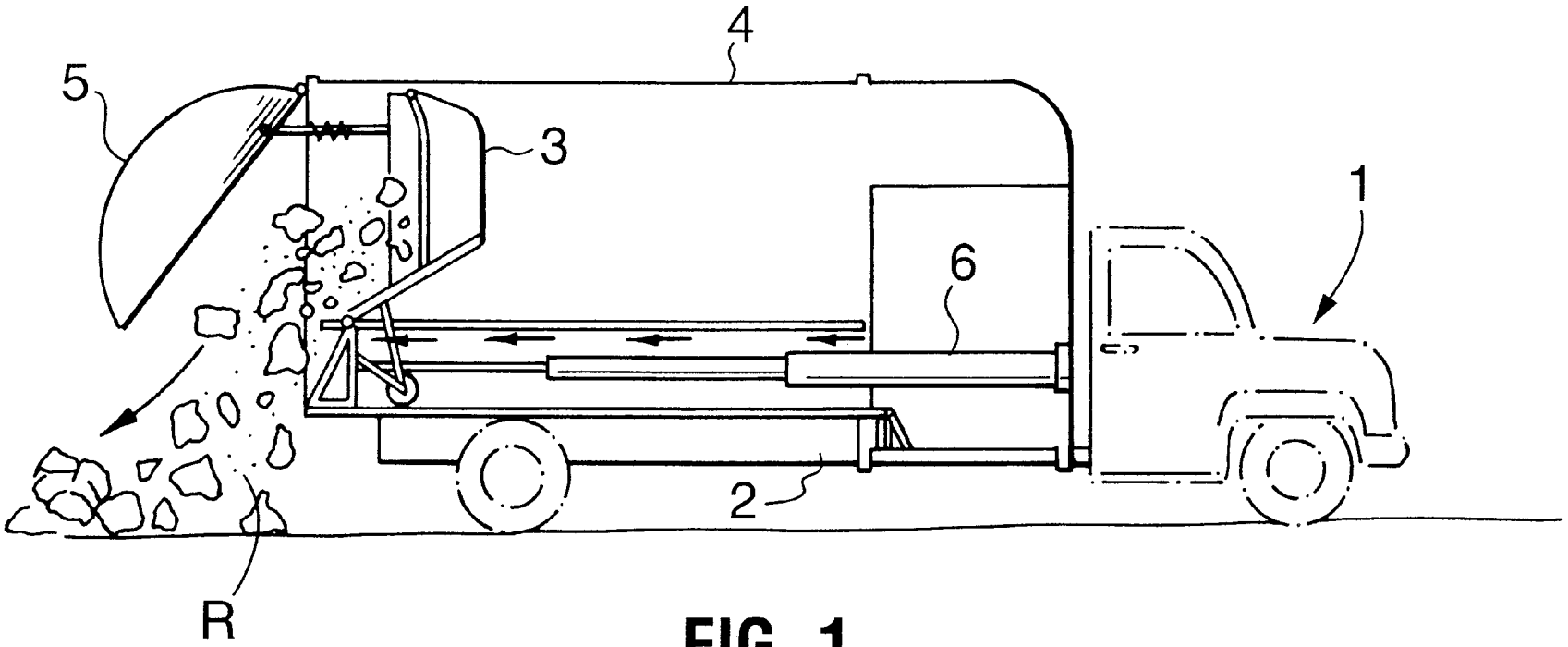
FIG. 1 PRIOR ART
FIG. 1 is a perspective view of a prior art construction of the container body.

Referring now in detail to FIG. 1 of the drawings, a prior art rear discharge recyclable material collection vehicle is indicated generally at 1, and includes a vehicle chassis 2, a cab and a container body 4 mounted thereon, material receiving buckets 3, a discharge end 5, and hydraulic discharge means 6.

Figure 2:
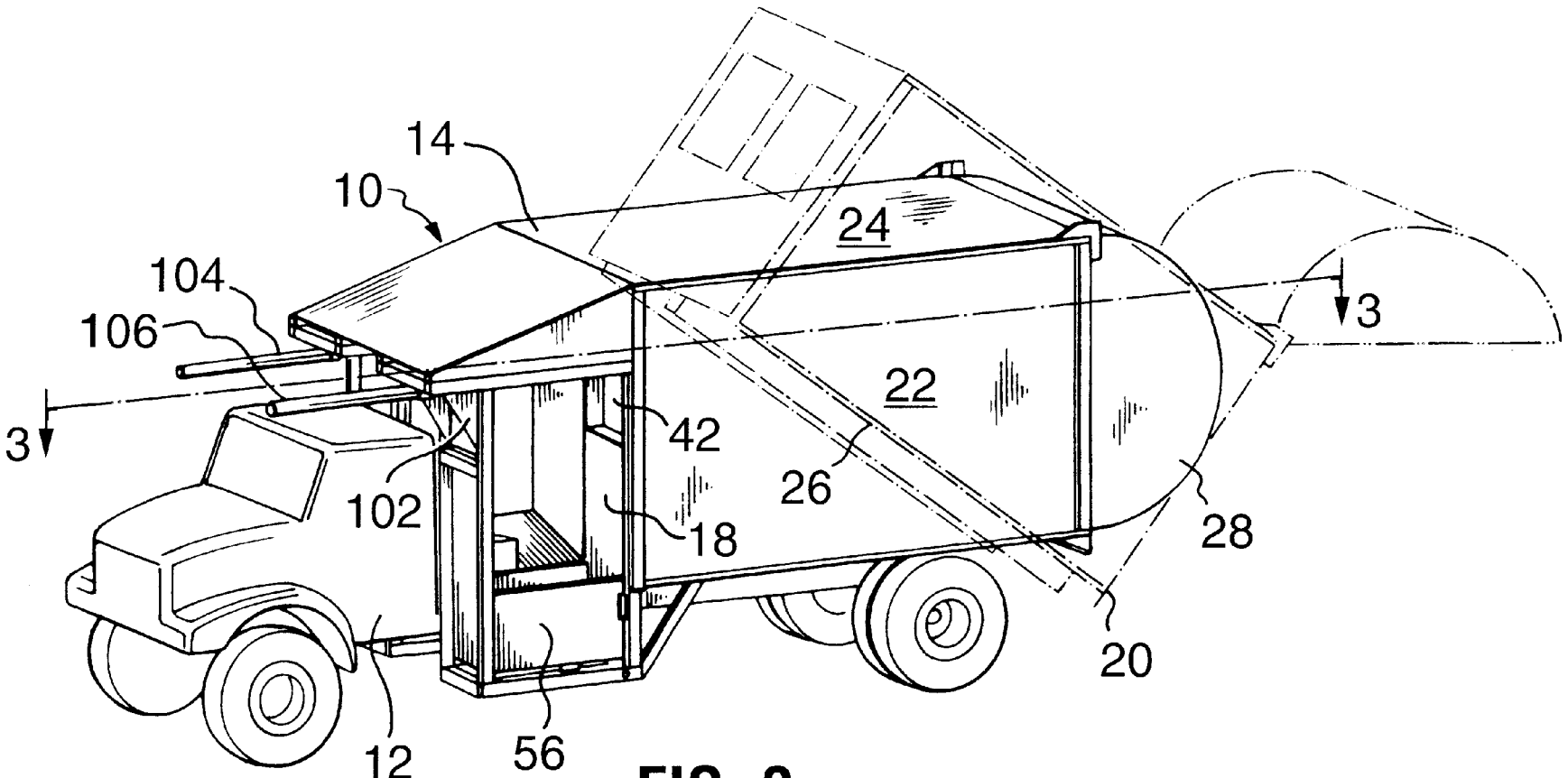
FIG. 2 is a perspective view of the container body invention mounted on a vehicle.

Referring now to FIG. 2 of the drawings, a rear discharge recyclable material collection vehicle of this invention indicated generally at 10, includes a vehicle chassis 12 which includes a cab and a container body 14 mounted thereon.

The container body 14 has a first end wall 18, a second arcuate end wall 20 forming a discharge end, two lateral side walls 22, a top wall 24, and a bottom wall 26.

Figure 3:
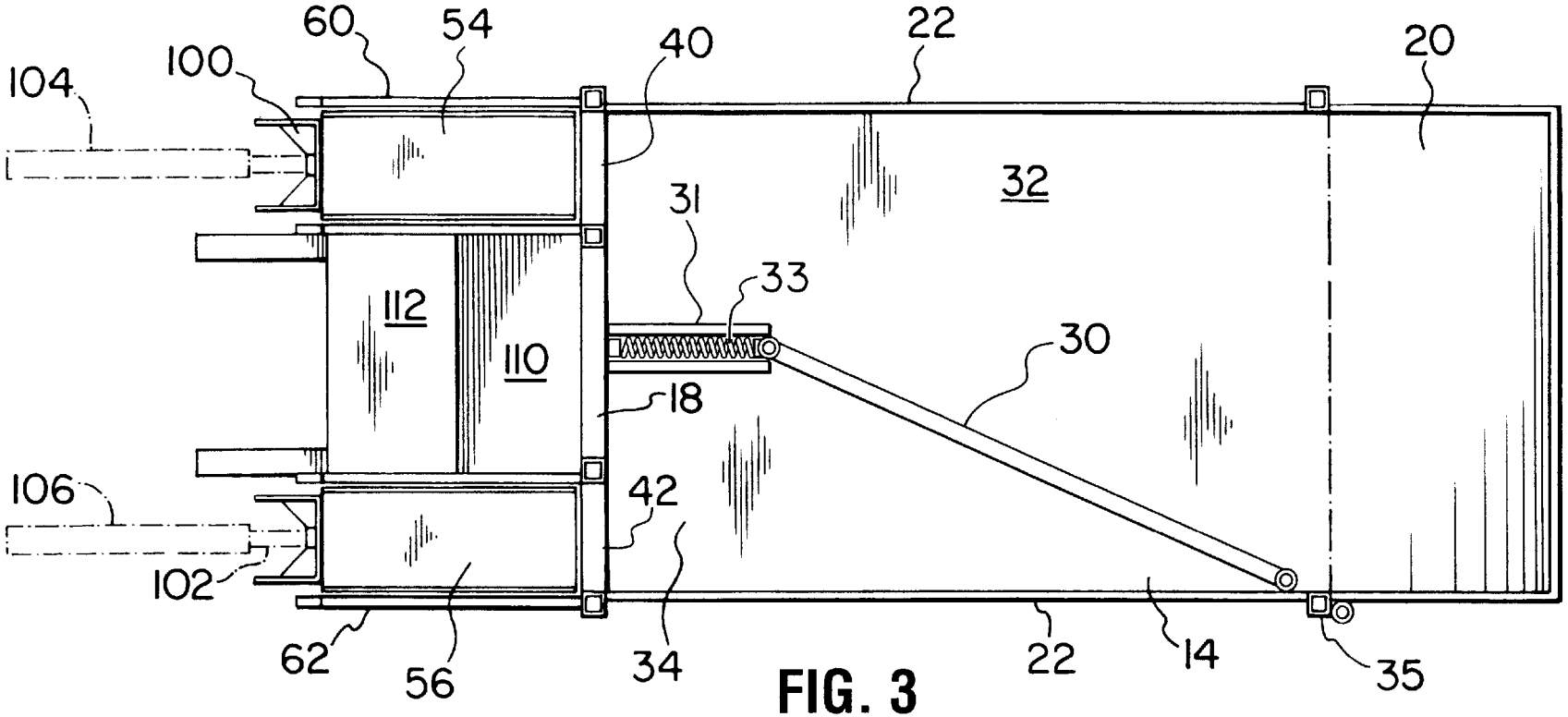
FIG. 3 is a top plan view of the container body taken along the line 3—3 of FIG. 2.

As shown in FIG. 3, a vertical partition 30 secured at one end by vertical walls 31, extends diagonally from the first end wall 18 toward the discharge end 20, and divides the container into two substantially triangular compartments 32 and 34. A hydraulic locking mechanism 35 including retractable pin is provided at the discharge end of the partition 30.

The discharge end 20 has a semi-cylindrical tailgate 28 pivotally mounted on an adjacent edge of the top wall 24 to permit material packed in both compartments 32 and 34 to be separately discharged by selective positioning of the partition 30 as shown in broken lines. A more detailed description of the unloading operation will be provided below.

Referring to FIGS. 2 and 3, the first end wall 18 has a pair of load receiving apertures 40 and 42 adjacent the top wall 24. The apertures 40 and 42 have sliding covers 40*a*and 42*a* including hydraulic actuating means.

Vertically disposed tubular frame members 46, 48 are provided adjacent the aperture 40, and similar frame members 50 and 52 as provided at side edges of the aperture 42.

The frame members 46, 48, 50 and 52 extend below the bottom wall 26, and form part of frame assemblies 60 and 62 to support loading buckets 54 and 56 respectively below the chassis 12 of the vehicle 10 so as to be at a convenient height for loading by an operator.

The frames 60 and 62 have vertical tubular members 64, 66,68, and 70 connected to frame members 46, 48, 50 and 52 by horizontal members 72 and diagonal reinforcing members 74. Suitable horizontal members 76 connect upper ends of the vertical members 64, 66, 68 and 70. The lower ends of vertical members 64, 66, 68 and 70 are connected by horizontal members 78.

It will be appreciated that the frame assemblies 60 and 62 guide the loading buckets 54 and 56 during upward travel to the loading apertures 40 and 42.

The loading buckets 54 and 56 are substantially identical and each has a bottom wall 80 and a pair of upright side walls 82 and 84 defining first and second open ends 86 and 88 respectively of the bucket 54 or 56.

Fixed walls 90 and 92 on each of the frame assemblies 60 and 62 blocks the open end of each bucket 54 and 56 during loading and upward travel.

Each of the frame assemblies 60 and 62 are preferably provided with a top wall 94 above each loading apertures 40 and 42.

Compressor blades 100 and 102 are mounted on hydraulic actuators such as piston cylinder assemblies 104 and 106.

The cylinders 104 and 106 are secured to upper horizontal frame members 76 as by brackets 108 in a conventional manner.

The dimensions of the compressor blades 100 and 102 are the same as the interior of the loading buckets 54 and 56 which are blocked by the blades 100 and 102 when the bucket 54 and 56 are in the upper position above fixed walls 90 and 92. Furthermore, the apertures 40 and 42 are preferably the same dimensions as the interior of the buckets 54 and 56.

In order to facilitate separation of the recyclable materials, each of the buckets 54 and 56 will be used exclusively for one general type of material. For example, assuming collection takes place on the right hand side of the street, paper, fibers and the like will be loaded into the bucket 54 and the compartment 32 of the container. Other materials will be moved down a chute 110 into the loading bucket 56 and the compartment 34.

If collection is from the left hand side of the vehicle, the operator can use a chute 112 to load the bucket 54 with paper, and other materials can be dropped directly into the loading bucket 56.

Figure 4:
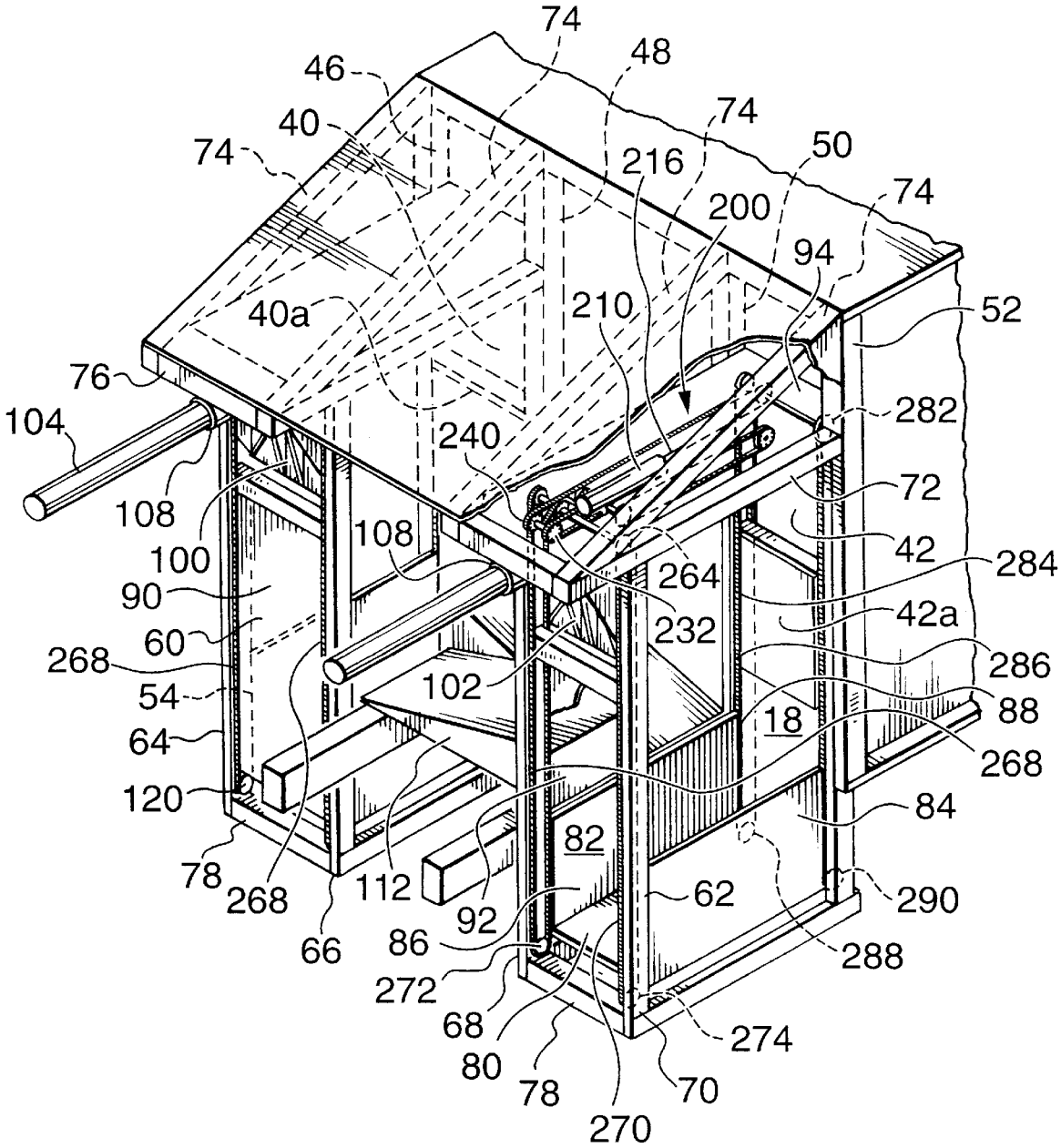
FIG. 4 is a perspective view of a front portion of the container showing the loading apparatus in greater detail.
Figure 5:
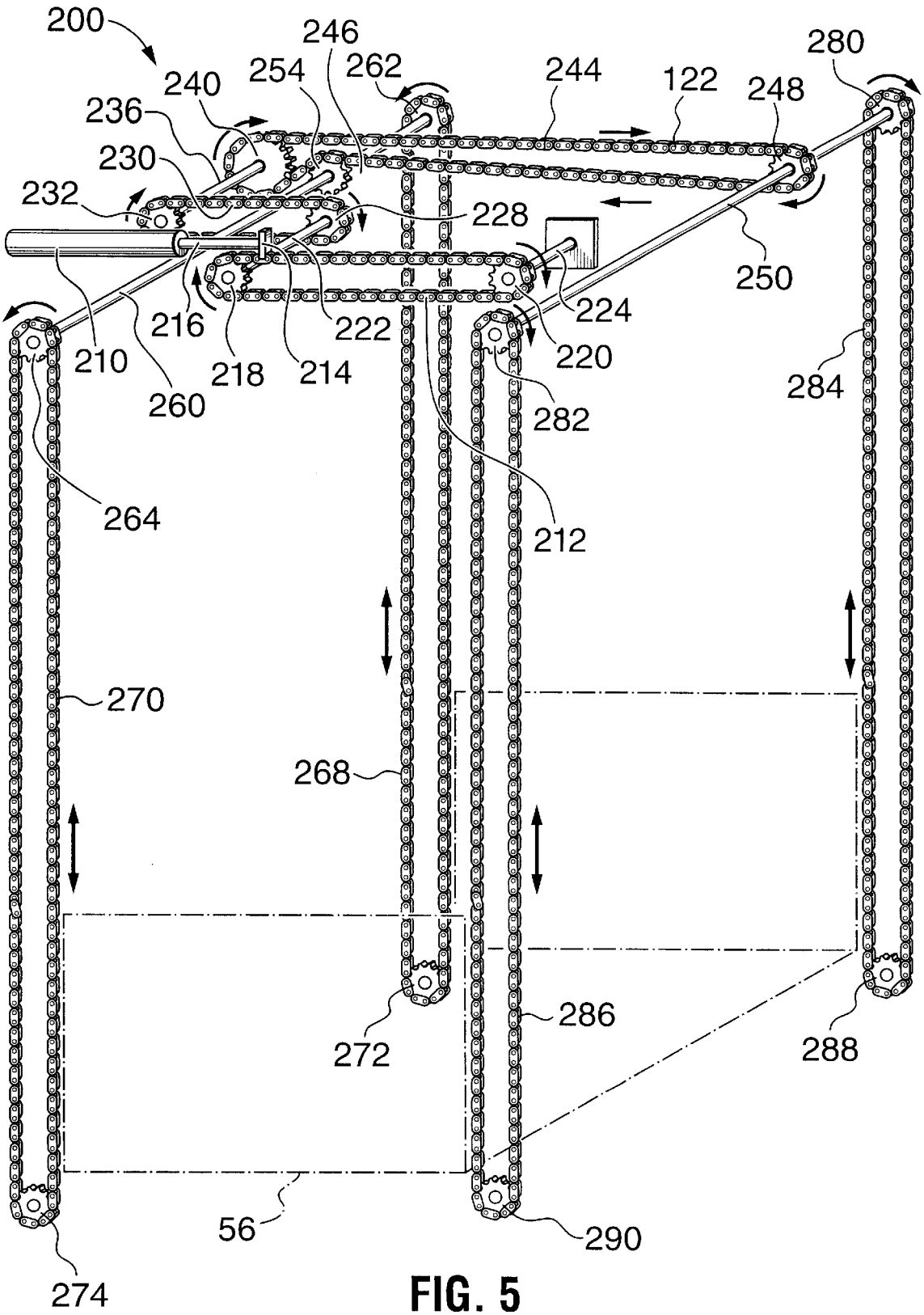
FIG. 5 is a diagrammatical representation of the bucket and lift means in the lowered position, and a hydraulic ram for compacting and/or unloading.

The lifting means for the buckets 54 and 56 is shown generally at 200 in FIGS. 4 and 5. The lift means for each of the bucket 54 are substantially identical and therefore only lift means 122 associated with the bucket 56 will be described.

The lift mechanism 200 is illustrated diagrammatically in FIG. 5 and includes a drive means 210 in the form of a hydraulic piston cylinder assembly mounted on the top wall 94 of the frame assembly 62. A drive chain 212 is connected by a suitable bracket 214 to the piston 216 of the drive means 210. The drive chain 212 entrains a pair of sprockets 218 and 220 mounted on the ends of shafts 222 and 224 respectively.

The sprocket 218 rotates with and drives the shaft 222 and a sprocket 228 on the other end of the shaft 222. A chain 230 entrains the sprocket 228 and a sprocket 232 on a shaft 236 also journaled for rotation on the top wall 94. The shaft 236 has a sprocket 240 at its outer end.

A chain 244 entrains the sprocket 240 and a sprocket 248 on an end of a shaft 250 extending across the wall 94. The chain 244 has an underside 246 engaging the periphery of a sprocket 254 which rotates across shaft 260. Ends of the shaft 260 are provided with sprockets 262 and 264 which are driven by the shaft 260 and have vertical chains 268 and 270 respectively which entrains lower sprockets 272 and 274 respectively.

Similarly, the shaft 250 has sprocket 280 and 282 at its outer ends for rotation therewith and vertical chains 284 and 286 which also entrains lower idler sprockets 288 and 290 respectively.

The container 14 has hydraulic lift means not shown to raise the container in a conventional manner as shown in broken lines in FIG. 1. As shown in FIG. 2, the container 14 may be lifted while the frame assemblies 60 and 62 remain fixed.

Operation of the collection vehicle 10 will be explained with particular reference to FIGS. 2, 3, 4 and 5. As shown in FIG. 4, the bucket 56 is in the lowered position where it is filled with the selected recyclable materials either paper and fibers or the other materials such as metal, plastic and glass. The compressor blade 100 is blocking the aperture 40 at this stage of the operating cycle. FIG. 4 illustrates the first stage of moving the bucket upwardly. The shafts 250 and 260 are rotated by the piston assembly 210 thereby providing upward movement of the chains 268, 270, 284 and 286 of the lifting means 200. The blade 100 is withdrawn to the position shown in FIG. 4. Continued upward movement of the bucket 54 results from the piston 216 moving the drive chain 212 and the chains 230 and 244 rotate the drive sprockets 262, 264, 280 and 282 to move the chains 268, 270, 284 and 286.

The diameter of the sprockets 232, 240 and 280 are chosen to increase the travel of the vertical chains by approximately one and one-half times the travel of the piston 216 to obtain the required lift of the bucket 56.

Upward movement of the bucket 56 as shown in FIG. 5 results from the piston 210 moving the chains 268, 270, 284 and 286 of the lifting mechanism 200 upward.

Compressing the recyclable materials and moving the compressed materials into the container 14 through the apertures 40 and 42 after the covers 40*a* and 42*a* have been removed. This is accomplished by operating the hydraulic cylinder and moving the compressor blade in the direction of the container 14. The raising and compacting steps can be carried out automatically while the operator is moving the vehicle 12 to another site. The covers 40*a* and 42*a* are replaced when the compressor blades 100 are retracted.

Unloading of the container body 14 is facilitated by the moveable diagonal vertical partition 30 in that a wide mouth is provided for the discharge of the contents of compartment 32 when the container 14 is raised in the conventional manner and the tail gate 28 at the discharge end 20 is unlatched by a conventional hydraulic means. The latching means of the partition 30 is then operated so that the partition 30 can be moved to a position approximately parallel with walls 22 thereby facilitating the discharge of the contents of the compartment 34. The spring 33 connecting the partition 30 to the wall 18 of the container 14 provides longitudinal adjustment of the partition 30 and retains the partition 30 within the container body 14 during discharge of the contents.

What is claimed is:

1. A refuse collecting container for use on a refuse collection vehicle, said container comprising:

first and second end walls, side walls, a top wall and a bottom wall, said first end wall having load receiving apertures, and the second end wall being a discharge end of the container;

at least two loading buckets each having a pair of upright side walls, and a bottom wall defining first and second ends of the bucket; and a compressor blade adjacent each of the buckets having actuator means for moving each blade through an adjacent bucket and an aligned one of the load receiving apertures in the first end wall of the container; and including a transversely adjustable vertical longitudinal partition extending from the first end wall to the discharge end of the container and dividing the container into two compartments including means for extending the partition longitudinally toward the discharge end of the container and releasable latching means provided on said partition at the discharge end of the container.

2. A refuse collecting container for use on a refuse collection vehicle, said container comprising:

first and second end walls, side walls, a top wall and a bottom wall, said first end wall having load receiving apertures, and the second end wall being a discharge end of the container;

at least two loading buckets each having a pair of upright side walls, and a bottom wall defining first and second ends of the bucket; and a compressor blade adjacent each of the buckets having actuator means for moving each blade through an adjacent bucket and an aligned one of the load receiving apertures in the first end wall of the container; and including a transversely adjustable vertical longitudinal partition extending from the first end wall to the discharge end of the container and dividing the container into two compartments, and wherein a compartment including parallel walls forming a channel is provided at an inner face of the first wall to receive an adjacent end of the vertical longitudinal partition and extensible means is provided between the first end wall and the vertical longitudinal partition.

3. A refuse collecting container as claimed in claim 2 wherein means for raising the bucket is provided on each bucket, the means for raising the bucket comprising:

a hydraulic cylinder means connected to a first drive chain entraining a drive sprocket and an idler sprocket;

a second chain driven by the drive sprocket;

a first shaft;

a sprocket on the first shaft driven by the second chain;

a second shaft having a sprocket and being driven by a third chain;

a third shaft intermediate the first and second shafts having a sprocket engaging an underside of the third chain; and the second and third shafts having sprockets at their ends to drive four vertically disposed chains provided with idler sprockets at lower ends thereof and connected to the bucket by fastening means.

4. A refuse collecting container as claimed in claim 3 wherein slidable covers are provided over the load receiving apertures in the first end wall of the container and hydraulic means is provided on the covers to move the covers away from the load receiving apertures during compacting.

* * * * *